US011066817B2

(12) United States Patent
Zeng

(10) Patent No.: US 11,066,817 B2
(45) Date of Patent: Jul. 20, 2021

(54) INTEGRALLY ASSEMBLED SINK

(71) Applicant: Yujie Sanitary Ware Co., Ltd., Foshan (CN)

(72) Inventor: Wen Zeng, Foshan (CN)

(73) Assignee: YUJIE SANITARY WARE CO., LTD., Foshan (CN)

( * ) Notice: Subject to any disclaimer, the term of this patent is extended or adjusted under 35 U.S.C. 154(b) by 23 days.

(21) Appl. No.: 16/571,356

(22) Filed: Sep. 16, 2019

(65) Prior Publication Data

US 2020/0407956 A1 Dec. 31, 2020

(30) Foreign Application Priority Data

Jun. 27, 2019 (CN) ..... 201921002723.X

(51) Int. Cl.
*E03C 1/18* (2006.01)

(52) U.S. Cl.
CPC ..... *E03C 1/18* (2013.01)

(58) Field of Classification Search
CPC ... A47B 77/06; E03C 1/18; E03C 1/14; E03C 1/16; E03C 1/182; E03C 1/32; E03C 1/33; E03C 1/35
See application file for complete search history.

(56) References Cited

U.S. PATENT DOCUMENTS

| | | | | |
|---|---|---|---|---|
| 2,784,418 | A * | 3/1957 | Luoma | E03C 1/186 4/514 |
| 5,538,206 | A * | 7/1996 | Sather | E03C 1/33 248/201 |
| 9,683,357 | B2 * | 6/2017 | Provencher | E03C 1/335 |
| 2012/0204343 | A1 * | 8/2012 | Shollmier | E03C 1/18 4/631 |
| 2015/0354188 | A1 * | 12/2015 | Hocaoglu | E03C 1/18 4/633 |
| 2018/0030704 | A1 | 2/2018 | Bomatter et al. | |
| 2018/0030705 | A1 | 2/2018 | Bomatter et al. | |
| 2018/0187400 | A1 * | 7/2018 | Chong | E03C 1/18 |

FOREIGN PATENT DOCUMENTS

| | | | | |
|---|---|---|---|---|
| CN | 107938776 | A | 4/2018 | |
| CN | 108787928 | A | 11/2018 | |
| CN | 109594620 | A | 4/2019 | |
| CN | 109687320 | A | 4/2019 | |
| FR | 846172 | A * | 9/1939 | E03C 1/33 |

* cited by examiner

*Primary Examiner* — Erin Deery
(74) *Attorney, Agent, or Firm* — Schmeiser, Olsen & Watts, LLP

(57) ABSTRACT

Provided is an integrally assembled sink, which includes a first frame made of a first material and a second sink body made of a second material, wherein the first frame is open at an upper end and a lower end and it has an upper opening at the upper end; and the second sink body is a container with a base and a top opening at its top. The first frame is sleeved on the second sink body, and an inside wall of the upper opening of the first frame is aligned with the inside wall of the second sink body. Several sets of bumps for hanging are arranged on the inside wall of the first frame, and each set of bumps includes horizontally symmetrical bumps protruding from the inside wall of the first frame.

12 Claims, 7 Drawing Sheets

INTEGRALLY ASSEMBLED SINK

CROSS REFERENCE TO RELATED APPLICATIONS

This application claims priority and benefit of CN 201921002723.X, entitled "Integrally Assembled Sink", filed on Jun. 27, 2019, the entire contents of which are hereby incorporated herein by reference.

TECHNICAL FIELD

The present invention relates to the technical field of sinks, in particular to an integrally assembled sink.

BACKGROUND

A sink is a device which is used for collecting gases with the drainage method or for holding plenty of water to wash tableware, food and so on, and the sink is mainly made of stainless steel, iron enamel and ceramic, etc. The existing sink is mostly made of a single material, and is formed in a monotonous appearance.

When installing an existing sink, an installing position in a certain size needs to be set at the countertop of a cupboard or a bathroom cabinet according to the size of the sink to be installed, then the sink is placed in the installation position and a glass cement or sealant is used to seal between the sink and the countertop. In an aspect, it is very troublesome to assemble and disassemble the sink. In another aspect, the sink has a poor adaptation with the countertop, thus the countertop may also have to be replaced when the sink needs to be replaced with another type, which increases the cost for replacing a sink.

Further, the existing installed sink is usually imbedded in the countertop and is located inside the cabinet body of the cupboard or the bathroom cabinet. For those obese people or pregnant women, their bulging abdomens probably will abut against the side wall of the cabinet body during usage, making their bodies or hands far from the sink, thus it is inconvenient for them to use.

SUMMARY

An aspect relates to provides an integrally assembled sink, which is well adapted with the countertop, convenient to assemble, disassemble and use, and easy to fulfill diverse demands in the applications.

Provided is an integrally assembled sink, comprising a first frame made of a first material and a second sink body made of a second material, wherein the first frame surrounds the second sink body which is a container with a base and a top opening and an edge of an upper opening of the first frame is aligned with the inside wall of the second sink body.

A plurality of opposed pairs bumps are arranged horizontally on an inside wall of the first frame, and a plurality of pairs of fixation components are configured between the first frame and the second sink body, wherein each pair of fixation components corresponds to a respective one of the plurality of opposed pairs of bumps; each pair of fixation component comprise two respective hooks for hanging on each corresponding pair of bumps, and a support member which is fixed to the corresponding hooks and for supporting the second sink body.

Further, each hook comprises a vertical portion and a first bent portion, and the first bent portion is at an angle of 90 degree to the vertical portion.

Each bump has a horizontal top surface and a vertical side surface. The first bent portion hangs on the top surface.

Further, each hook further comprises a second bent portion for fixing the support member, and the second bent portion is at an angle of 90 degree to the vertical portion and bends in the same direction with the first bent portion.

Further, the inside wall of the first frame inclines outward from top to bottom so as to keep the second bent portion away from the inside wall of the first frame.

Further, each support member is provided with connecting holes at both ends, through the connecting holes, each support member is detachably connected to the corresponding hooks via bolt connecting components.

Further, an inward flange is configured at a top of the first frame.

Further, the inward flange has a double-step structure.

Further, the second sink body is configured with an outward flange in the position adjacent to a top of the second sink body for preventing the second sink body from deformation.

Further, the first material is one or a combination selected from artificial stone, ceramic tile, natural stone, wood, bamboo, leather and plastic, and the second material is stainless steel.

Comparing to the prior art, the present invention has the following beneficial effect:

The integrally assembled sink according to the invention connects the first frame to the second sink body as a whole by supporting the second sink body with fixation components, thus the whole sink can be placed at the installation position on the countertop or under the countertop, which changes the assembly mode for the current embedded sink and improves the convenience and efficiency for installing the sink on spot. The sink can be configured to protrude from the façade of the cabinet body, and this is convenient for the user to stand in front of the sink, as there is enough room for the feet under the sink, and the users do not need to bend, which is particularly suitable for the obese people or the pregnant women.

The integral structure of the first frame and the second sink body enable the whole sink to be installed on the countertop, instead of being embedded in the inside of the cabinet, which facilities the installment and maintenance.

In addition, a larger range of material of the first frame can be applied due to the design of the second sink body and the first frame, which makes the sink meet the requirement of the diverse design in different applications and fulfill the pursuit of modern people.

BRIEF DESCRIPTION OF DRAWINGS

The present invention will be further described in detail hereinafter with reference to the accompanying figures and detailed embodiments.

LIST OF REFERENCE NUMBERS

Figure 1:
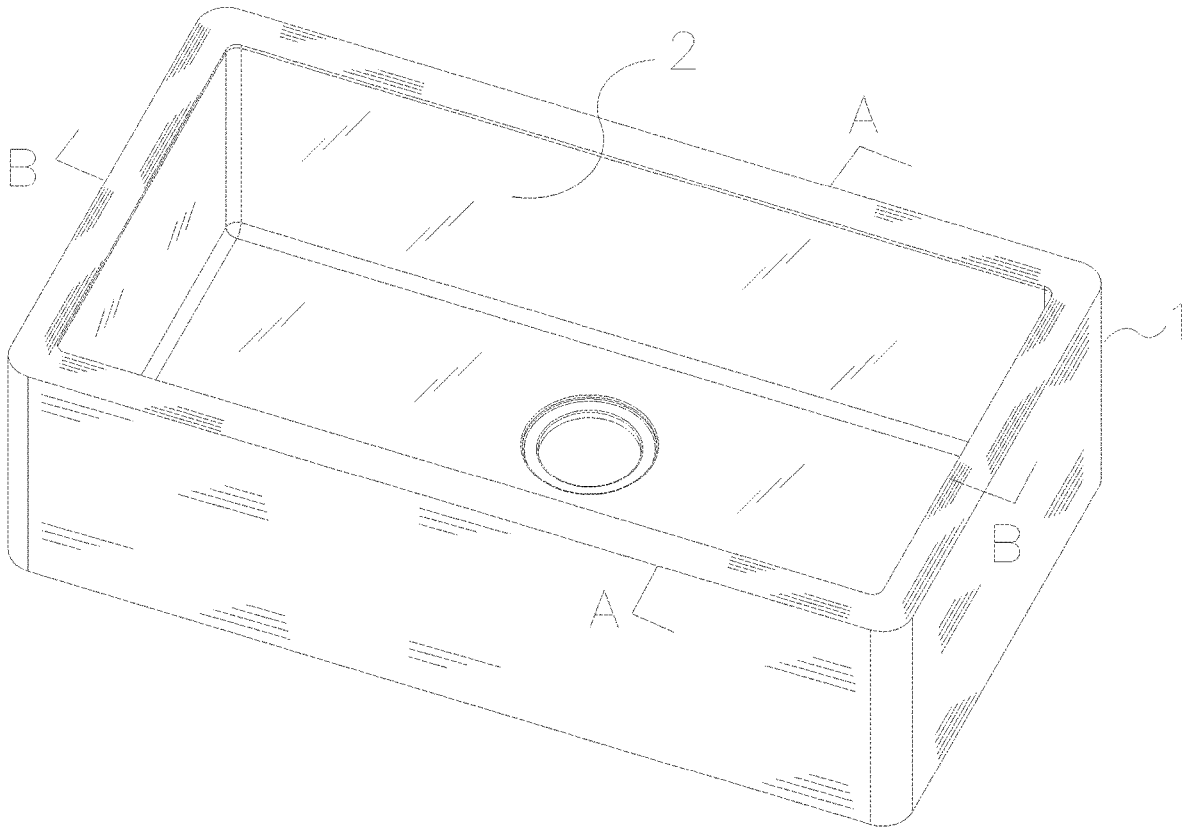
FIG. 1 is a structural schematic view of an integrally assembled sink according to the present invention.

1 First frame
11 Inside wall of the first frame
12 Bump
121 Top surface
122 Side surface
13 Inward flange
131 Bottom surface of upper step
14 Groove
15 Inside wall of the upper opening
2 Second sink body
21 Top
22 base
23 Outward flange
24 Inside wall of the second sink body
3 Fixation components
31 Hook
311 Vertical portion
312 First bent portion
313 second bent portion
314 Bolt hole
32 Support member
321 Connecting hole
33 Bolt connecting component

DETAILED DESCRIPTION

Preferred embodiments of the present invention will be described hereinafter with reference to the accompanying figures. It should be appreciated that the preferred embodiments described herein are only for explanation and illustration, but not the limitation to the present invention.

Figure 2:
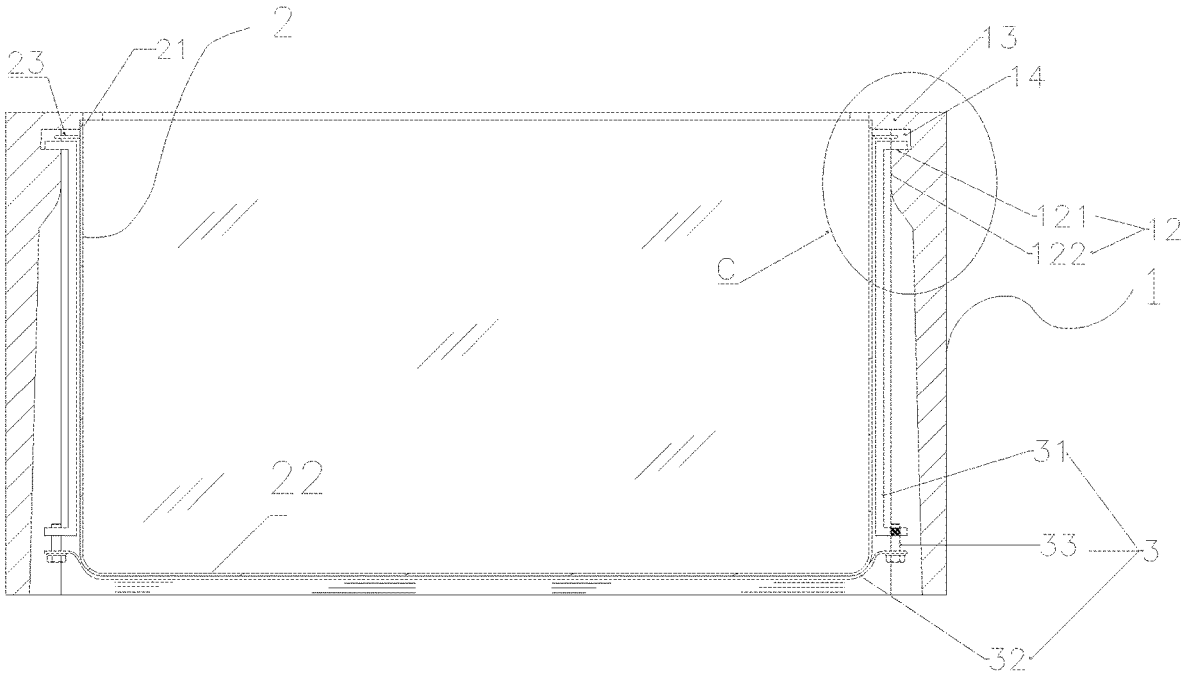
FIG. 2 is a sectional view of Line A-A in FIG. 1.
Figure 3:
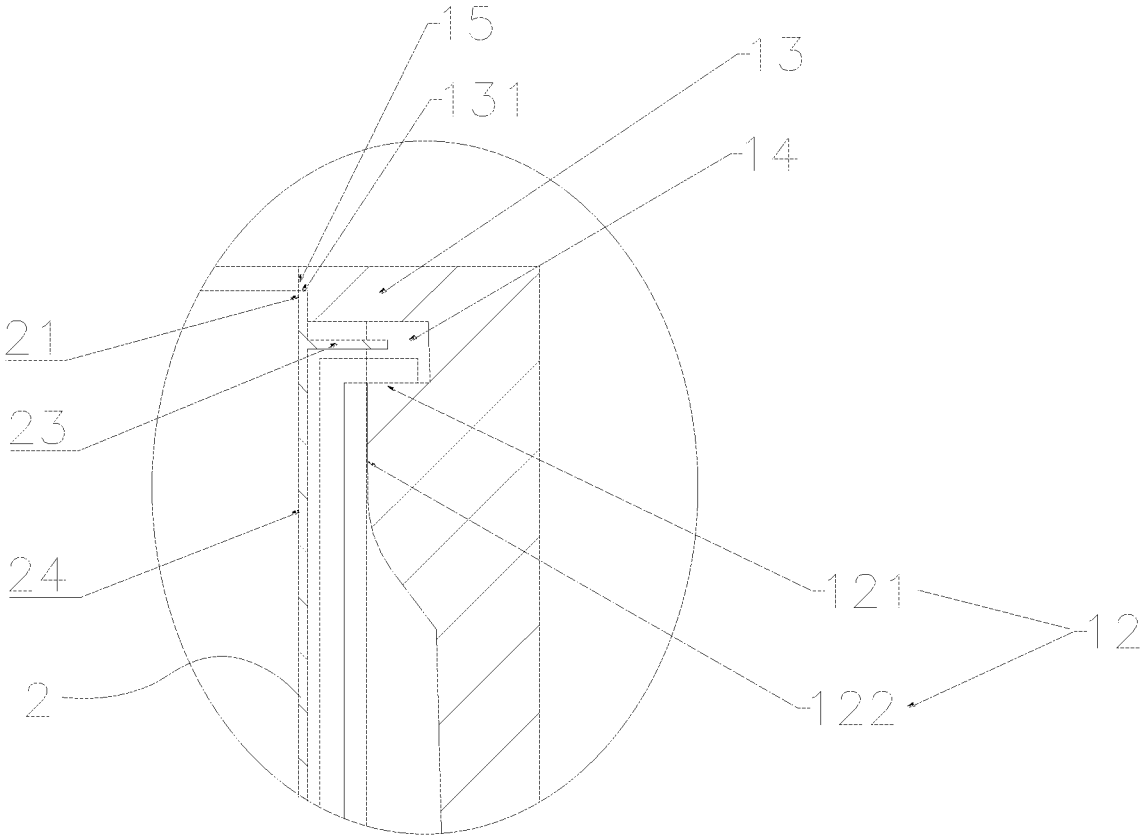
FIG. 3 is an enlarged view of Part C in FIG. 2.
Figure 4:
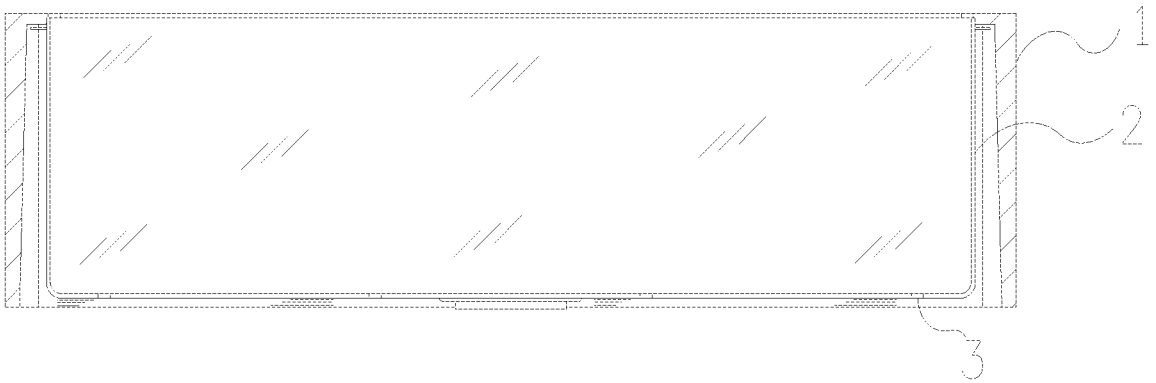
FIG. 4 is a sectional view of Line B-B in FIG. 1.
Figure 5:
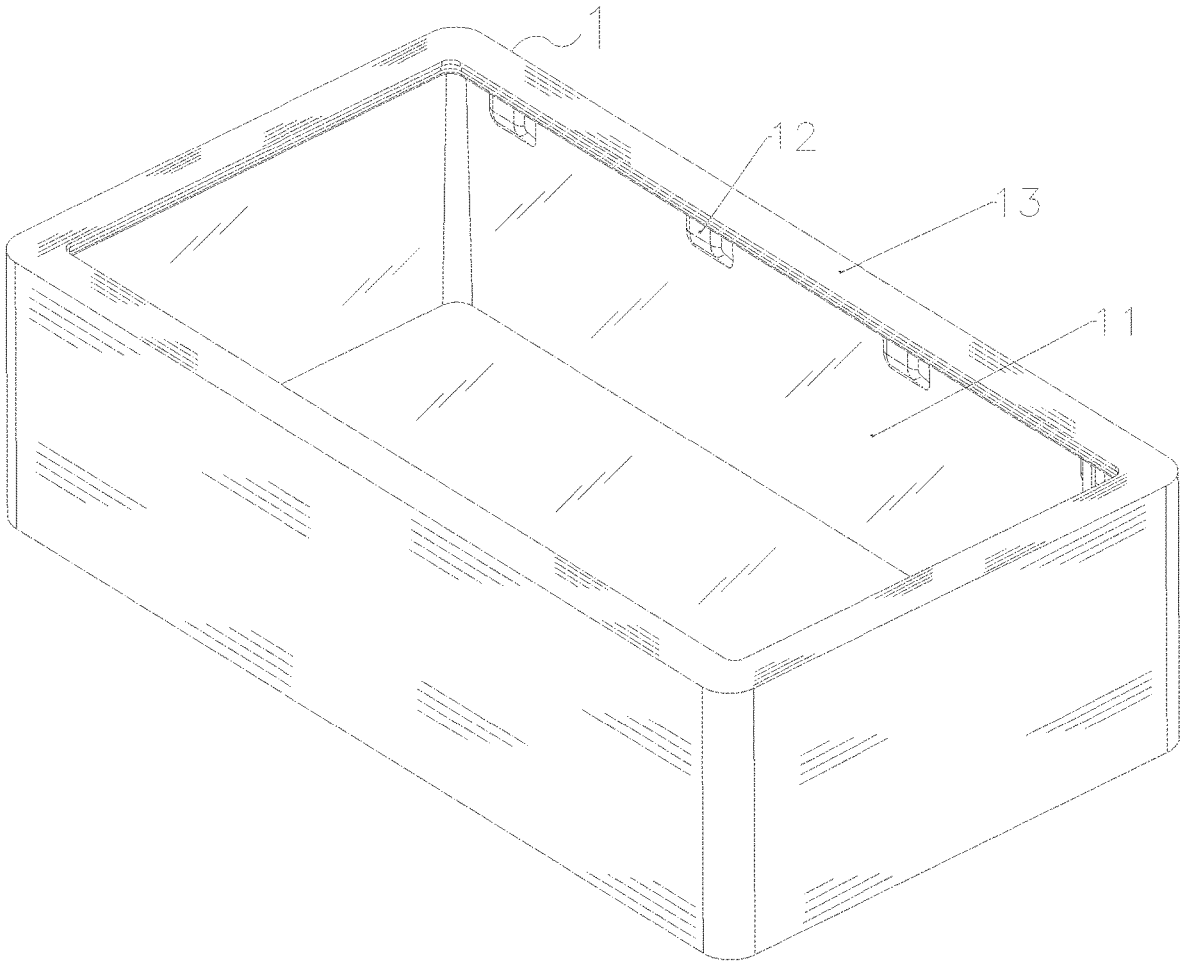
FIG. 5 is a structural schematic view of a first frame according to the present invention.
Figure 6:
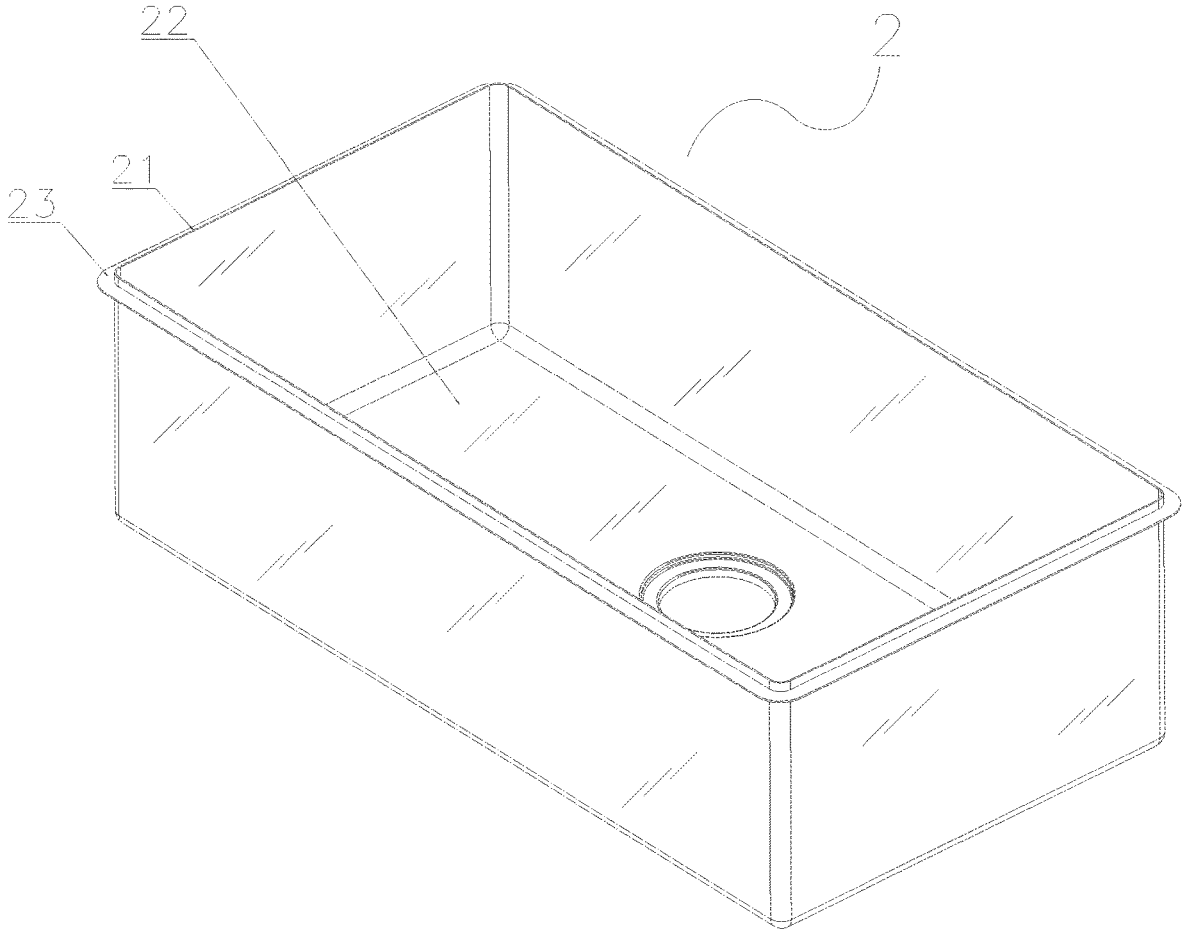
FIG. 6 is a structural schematic view of a second sink body according to the present invention.
Figure 7:
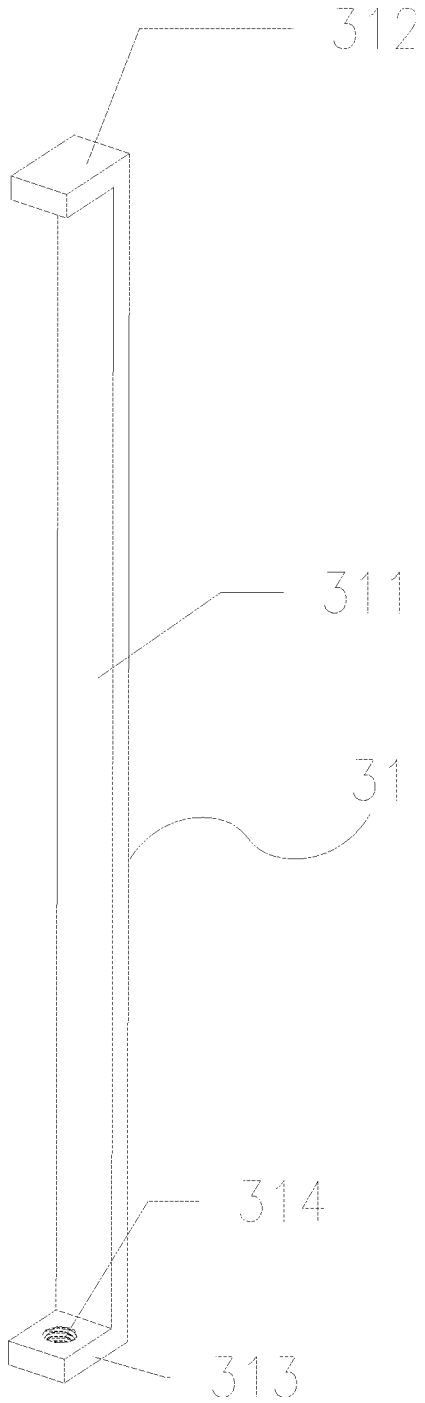
FIG. 7 is a structural schematic view of a hook according to the present invention.
Figure 8:
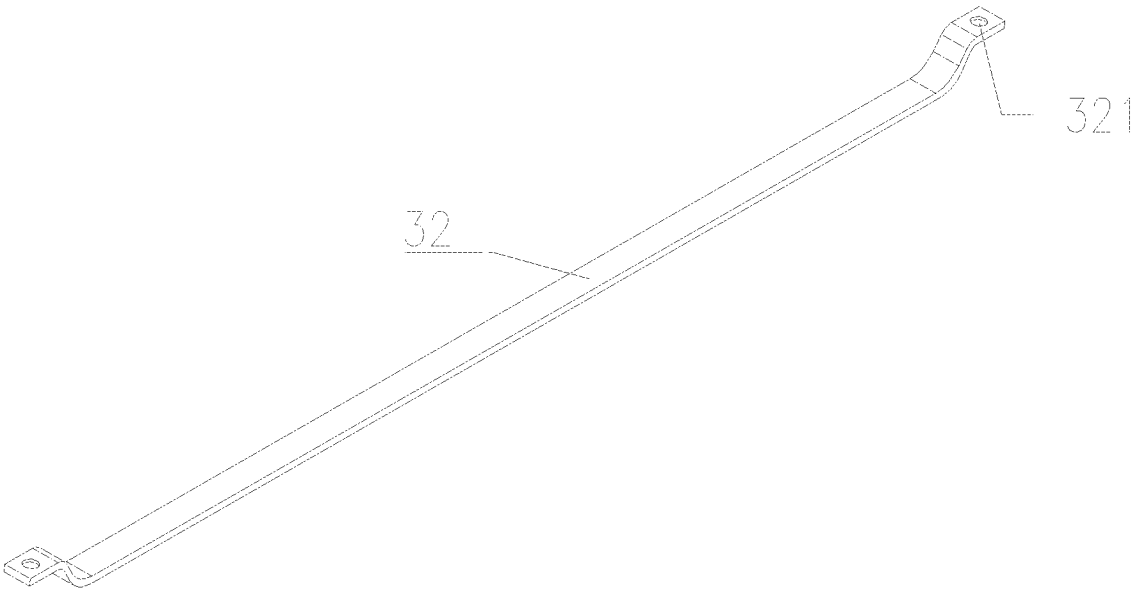
FIG. 8 is a structural schematic view of a holder according to the present invention.

The present invention discloses an integrally assembled sink, which comprises a first frame 1 made of a first material and a second sink body 2 made of a second material, as shown in FIGS. 1-8. The second material is generally stainless steel, and the first material can be one or a combination selected from artificial stone, ceramic tile, natural stone, wood, bamboo, leather and plastic. The first frame 1 surrounds the second sink body 2 which is a container with a base and a top opening.

After the assembly, an edge of the upper opening 15 of the first frame is aligned with the inside wall of the second sink body 24.

A plurality of opposed pairs bumps are arranged horizontally on an inside wall of the first frame, and a plurality of pairs of fixation components are configured between the first frame 1 and the second sink body 2, wherein each pair of fixation components corresponds to a respective one of the plurality of opposed pairs of bumps; each pair of fixation component comprise two respective hooks 31 for hanging on each corresponding pair of bumps, and a support member 32 which is fixed to the corresponding hooks and for supporting the second sink body 2.

Based on the above structural design, the integrally assembled sink according to the invention connects the first frame 1 with the second sink body as a whole by supporting the second sink body 2 with the fixation components 3, thus the whole sink can be placed on the countertop, which improves the convenience and efficiency for installing the sink on spot. The sink can be configured to protrude from the façade of the cabinet body, and this is convenient for the user to stand in front of the sink, as there is enough room for the feet under the sink, and the users do not need to bend, which is particularly suitable for the obese people or the pregnant women.

The integral structure of the first frame 1 and the second sink body 2 enable the whole sink to be installed on the countertop, instead of being embedded inside the cabinet, which facilitates the installment and maintenance.

In addition, first frame 1 bears less weight as the fixation components 3 are used to support the second sink body 2, thereby larger range of material of the first frame 1 can be applied, which makes the sink meet the requirement of the diverse design in different applications and fulfill the pursuit of modern people.

The hooks 31 and the support member 32 are both made of steel.

As a preferred embodiment, as shown in FIGS. 1-8, the first frame 1 is open at both ends, and an inward flange 13 is configured at the top of the first frame 1. The inward flange 13 has an inverted double-step structure, and a top 21 of the second sink body 2 abuts against the bottom surface of upper step 131 of the inward flange 13. Thus, when the second sink body 2 is fitted into the first frame 1, the edge of upper opening 15 of the first frame is aligned with the inside wall of the second sink body 24, then the whole inside wall of the sink is in an even plane.

In the above embodiment, as shown in FIGS. 1-8, the second sink body 2 is configured with an outward flange 23 at the periphery of the sidewall adjacent to the top of the second sink body. The outward flange 23 does not bear weight directly, and it effectively prevents the second sink body 2 from deformation. When using, a binding agent can be applied on the outer edges of the four corners of the outward flange 23, thus the outward flange 23 can be adhered to the inside wall of the first frame 11.

In the above embodiment, each bump 12 is located under the inward flange 13, and a groove 14 for holding the corresponding hook and outward flange 23 is provided between the respective bump 12 and the respective lower step of the double-step structure of the inward flange 13.

Specifically, as shown in FIGS. 1-8, each bump 12 has a horizontal top surface 121 and a vertical side surface 122.

Each hook 31 is formed by a straight bar, both ends of which are bent at an angle of 90 degree. Each hook 31 comprises a vertical portion 311, a first bent portion 312 and a second bent portion 313, wherein the first bent portion 312 is at an angle of 90 degree to the vertical portion 311, and the second bent portion 313 is at an angle of 90 degree to the vertical portion 311.

The first bent portion 312 of each hook 31 extends into the corresponding groove 14 and is fixed to the top surface 121 of the corresponding bump 12. The second bent portion 313 of each hook 31 is configured with a bolt hole 314.

Each support member 32 is provided with connecting holes 321 at both ends respectively, through the connecting hole 321, each support member is detachably connected to the corresponding hooks 31 via bolt connecting components 33. Such a detachable configuration facilitates disassembly and assembly and transportation.

The inside wall of the first frame 11 inclines outward from top to bottom so as to keep the second bent portion 313 away from the inside wall of the first frame 11. At the meantime, it facilitates the disassembly and assembly between each hook 31 and each support member 32.

In order to better illustrate the invention, it will demonstrate how to assemble the integrally assembled sink below.

Hang and fix each hook 31 to the corresponding bump 12, respectively;

Fit the second sink body 2 into the first frame 1 through the bottom of the first frame 1, after a binding agent is applied on the outer edges of the four corners of the outward flange 23;

Fix each support member 32 to the corresponding hooks 31 via bolt connecting components 33, thereby the second sink body 2 can be fixed within the first frame 1 to complete the assembly;

Place the assembled sink at the installation position of a cupboard or a bathroom cabinet.

Other contents about the integrally assembled sink according to the present invention may refer to the prior art and will not be repeated here.

The present invention should not be limited to those embodiments described above, which are just preferable embodiments, and any amendments, equivalent changes and modifications to these embodiments, without departing from the spirit essence and principle of the present invention, are included in the scope of the present invention.

The invention claimed is:

1. An integrally assembled sink, comprising:

a first frame made of a first material and a second sink body made of a second material, wherein the first frame surrounds the second sink body, the second sink body being a container with a base and a top opening, and an edge of an upper opening of the first frame is aligned with an inside wall of the second sink body;

a plurality of opposed pairs of bumps are arranged horizontally on an inside wall of the first frame, and a plurality of pairs of fixation components are configured between the first frame and the second sink body, wherein each pair of fixation components corresponds to a respective one of the plurality of opposed pairs of bumps; each pair of fixation components comprises a pair of opposed hooks for hanging on each corresponding pair of bumps, and further comprises a support member, which is fixed to the pair of opposed hooks for supporting the second sink body;

each hook comprises a vertical portion and a first bent portion, and the first bent portion, and the first bent portion is at an angle of 90 degrees to the vertical portion;

each bump has a horizontal top surface and a vertical side surface, wherein the first bent portion hangs on the top surface;

each hook further comprises a second bent portion for fixing to the respective support member, and the second bent portion is at an angle of 90 degrees to the vertical portion and bends in the same direction with the first bent portion.

2. The integrally assembled sink according to claim 1, wherein the inside wall of the first frame inclines outward from top to bottom so as to keep the second bent portion away from the inside wall of the first frame.

3. The integrally assembled sink according to claim 2, wherein the first material is one or a combination selected from artificial stone, ceramic tile, natural stone, wood, bamboo, leather and plastic; the second material is stainless steel.

4. The integrally amended sink according to claim 1, wherein each support member has opposed ends and is provided with a connecting hole at each end, and each support member is detachably connected to a respective one of the pair of opposed hooks via bolt connecting components extending through each connecting hole.

5. The integrally assembled sink according to claim 4, wherein the first material is one or a combination selected from artificial stone, ceramic tile, natural stone, wood, bamboo, leather and plastic; the second material is stainless steel.

6. The integrally assembled sink according to claim 1, wherein an inward flange is configured at a top of the first frame.

7. The integrally assembled sink according to claim 6, wherein the first material is one or a combination selected from artificial stone, ceramic tile, natural stone, wood, bamboo, leather and plastic; the second material is stainless steel.

8. The integrally assembled sink according to claim 6, wherein the inward flange has a double-step structure.

9. The integrally assembled sink according to claim 7, wherein the first material is one or a combination selected from artificial stone, ceramic tile, natural stone, wood, bamboo, leather and plastic; the second material is stainless steel.

10. The integrally assembled sink according to claim 1, wherein the second sink body is configured with an outward flange in a position adjacent to a top of the second sink body for preventing the second sink body from deformation.

11. The integrally assembled sink according to claim 8, wherein the first material is one or a combination selected from artificial stone, ceramic tile, natural stone, wood, bamboo, leather and plastic; the second material is stainless steel.

12. The integrally assembled sink according to claim 1, wherein the first material is one or a combination selected from artificial stone, ceramic tile, natural stone, wood, bamboo, leather and plastic; the second material is stainless steel.

* * * * *